US010605566B1

(12) United States Patent
Chiang

(10) Patent No.: US 10,605,566 B1
(45) Date of Patent: Mar. 31, 2020

(54) SIGHTING DEVICE

(71) Applicant: Long Perng Co., LTD, Taoyuan (TW)

(72) Inventor: Chun-Hsien Chiang, Taoyuan (TW)

(73) Assignee: LONG PERNG CO., LTD, Taoyuan (TW)

( * ) Notice: Subject to any disclaimer, the term of this patent is extended or adjusted under 35 U.S.C. 154(b) by 0 days.

(21) Appl. No.: 16/231,440

(22) Filed: Dec. 22, 2018

(30) Foreign Application Priority Data

Sep. 6, 2018 (TW) ..... 107212227 U

(51) Int. Cl.
*F41G 1/34* (2006.01)
*F41G 1/38* (2006.01)

(52) U.S. Cl.
CPC ..... *F41G 1/345* (2013.01); *F41G 1/38* (2013.01)

(58) Field of Classification Search
CPC ..... F41G 1/345; F41G 1/38
See application file for complete search history.

(56) References Cited

U.S. PATENT DOCUMENTS

2012/0297658 A1* 11/2012 Lupher ..... F41A 17/06 42/69.01
2015/0308787 A1* 10/2015 Cheng ..... F41G 1/34 42/126
2018/0135945 A1* 5/2018 Maryfield ..... F41G 11/00

FOREIGN PATENT DOCUMENTS

KR 20170079422 A * 7/2017

* cited by examiner

*Primary Examiner* — Anh T Mai
*Assistant Examiner* — Glenn D Zimmerman
(74) *Attorney, Agent, or Firm* — Chun-Ming Shih

(57) ABSTRACT

A sighting device includes a body, a lighting unit, a touch unit, and a controller, wherein the lighting unit, the touch unit, and the controller are disposed on the body, and the controller is electrically connected to the touch unit and the lighting unit. The body has an accommodating space for accommodating a lens or at least one lens assembly. A reticle or an optical beam splitter is disposed in the accommodating space, and a light generated by the lighting unit is projected onto a scale or hairline of the reticle or the optical beam splitter. The touch unit senses an external touch and generates a touch signal in correspondence to the external touch, and the controller adjusts the brightness level and/or the color of the light generated by the lighting unit based on the touch signal.

7 Claims, 9 Drawing Sheets

SIGHTING DEVICE

REFERENCE TO RELATED APPLICATIONS

This non-provisional application claims priority claim under 35 U.S.C. § 119(a) on Taiwan Patent Application No. 107212227 filed Sep. 6, 2018, the entire contents of which are incorporated herein by reference.

FIELD OF THE INVENTION

The invention relates to a sighting device, more particularly, to a sighting device that is capable of sensing an external touch with a touch unit on the sighting device and adjusting, via a controller, the brightness level or color of a light generated by a lighting unit according to a touch signal transmitted by the touch unit.

BACKGROUND

A sight is an optical aiming device that is conventionally used with military weapons like rifles. The optical system of the sight usually has a marking at a suitable location to provide users a precise aiming reference for improving sighting accuracy of the military weapons.

With the social economic advancement, the range which sighting devices are being used is no longer limited to military weaponry. Currently, sights are often used as accessories in shooting sports and shooting games to lower the difficulty for entry level to the shooting sports and games, for example, disposing sights on guns, bows, or crossbows to increase the hit rate.

However, conventional sights still have limitations during usage, such as users may not be able to see the marking of the sight clearly in a darker environment, making it difficult to use and in turn lowers the hit rate.

SUMMARY

The invention provides a sighting device, which includes a touch unit, a controller, and at least one lighting unit, wherein the touch unit transmits a touch signal to the controller and the controller adjusts the brightness level and/or color of the lighting unit according to the touch signal, thereby enhancing the usability and convenience of the sighting device. In other words, based on the light source or brightness of the surrounding environment, user can adjust the brightness level and/or color of the lighting unit via the touch unit.

The sighting device of the invention can be a telescopic sight or a red dot sight, wherein the brightness level and/or color of a crosshair reticle pattern or a red dot pattern of the sight can be adjusted by touching the touch unit during usage. Moreover, the sighting device of the invention can be used in combination with shooting devices like pistols, rifles, bows, or crossbows to enhance the convenience and sighting accuracy when using the device.

The present invention provides a sighting device, which includes a body, a reticle, at least one lighting unit, at least one touch unit, and a controller. The body has an accommodating space, and in the accommodating space is disposed a lens or at least one lens assembly. The reticle is disposed in the accommodating space of the body. The lighting unit is disposed on the body for generating a light and projecting the light onto the reticle, which forms a reticle pattern on the reticle. The touch unit is disposed on the body for sensing an external touch and generating a touch signal in correspondence to the external touch. The controller is disposed on the body and electrically connected to the touch unit and the lighting unit, and the controller adjusts a brightness level and/or color of the light generated by the lighting unit according to the touch signal transmitted by the touch unit.

The present invention provides another sighting device, which includes a body with an accommodating space, an optical beam splitter disposed in the accommodating space of the body, at least one lighting unit for generating a light and projecting the light onto the optical beam splitter, at least one touch unit disposed on the body for sensing an external touch and generating a touch signal in correspondence to the external touch, and a controller disposed on the body and electrically connected the touch unit and the lighting unit, wherein the controller adjusts a brightness level and/or color of the light generated by the lighting unit according to the touch signal transmitted by the touch unit.

In one embodiment of the invention, the sighting device includes one marking or at least one marking dot placed on the reticle, and the light generated by the lighting unit is projected onto the marking or the marking dot for users to view the marking or the marking dot more easily and in turn can perform aiming and ballistic correction.

In one embodiment of the invention, the sighting device further includes a first lens and a second lens disposed at two ends of the body, respectively, and the reticle or the optical beam splitter is disposed between the first lens and the second lens.

In one embodiment of the invention, the sighting device further includes a power unit for providing power to the controller, the lighting unit, and the touch unit.

In one embodiment of the invention, the touch unit includes at least one touchpad and at least one mount, wherein the mount has an annular structure and is used to mount the touchpad on the body and to expose a part of the touchpad.

In one embodiment of the invention, the touch unit is circular, triangular, square, rectangular, or polygonal.

In one embodiment of the invention, the optical beam splitter is disposed between the first lens and the second lens and made of a light transmitting material, and the surface of the optical beam splitter has one or more layers of coating thereon.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 1:
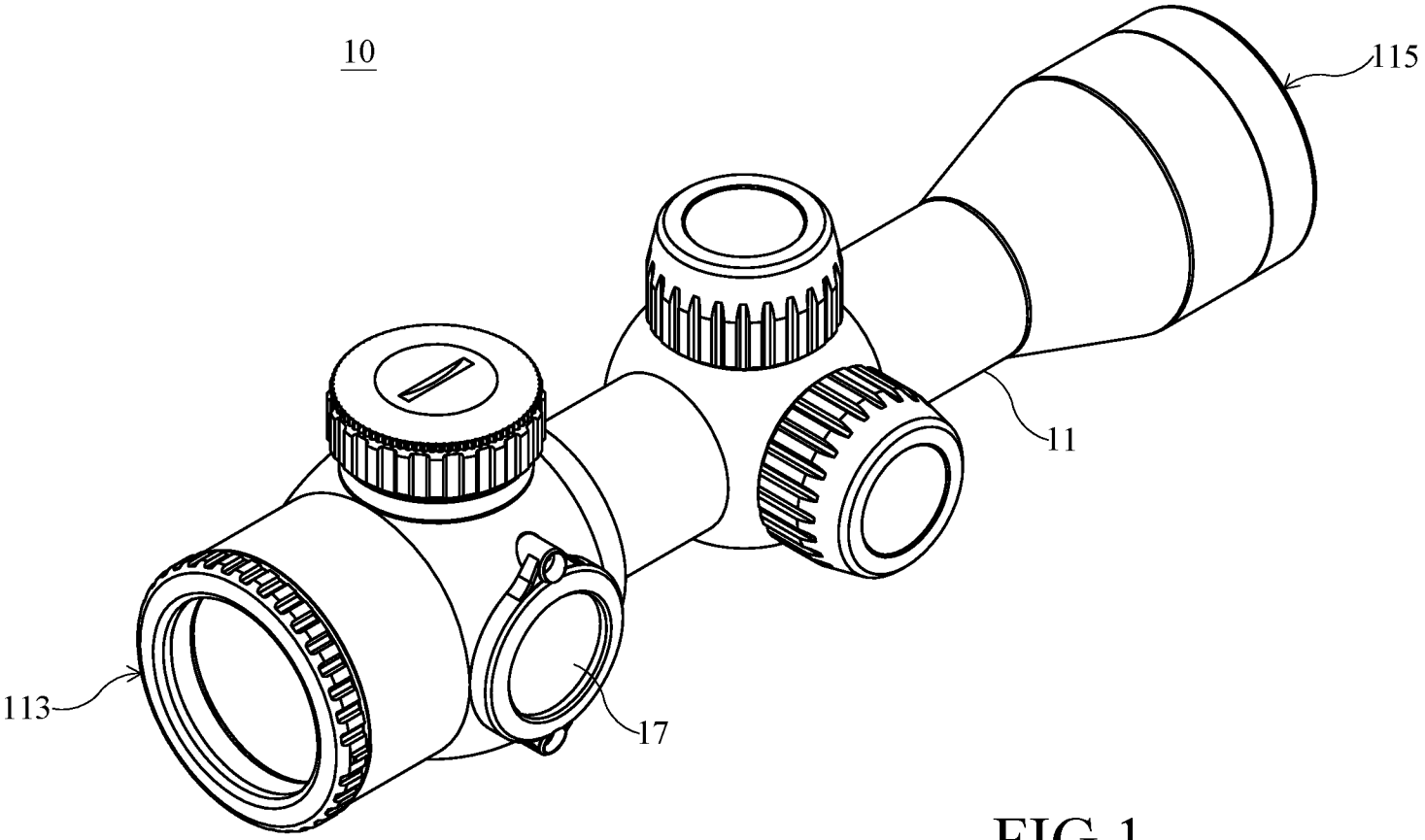
FIG. 1 is a schematic diagram of a sighting device according to an embodiment of the invention.
Figure 2:
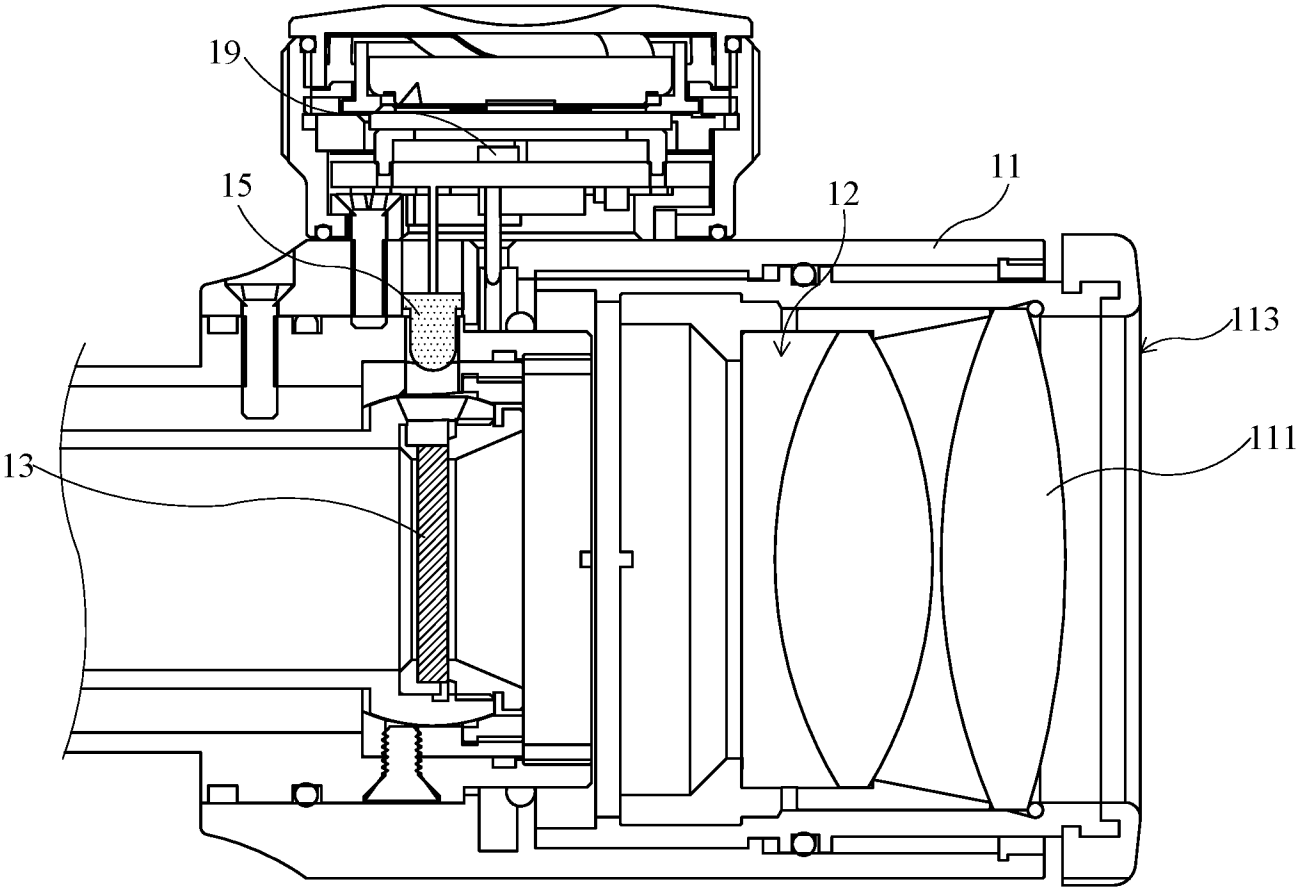
FIG. 2 is a cross-sectional schematic diagram illustrating a portion of a sighting device according to an embodiment of the invention.

FIGS. 1 and 2 are, respectively, a schematic diagram of a sighting device and a cross-sectional schematic diagram illustrating a portion of the sighting device according to a preferred embodiment of the invention. The sighting device 10 includes a body 11, a reticle 13, at least one lighting unit 15, at least one touch unit 17, and a controller 19, wherein the body 11 is a hollow tube with an accommodating space 12.

The sighting device 10 further includes a lens or at least one lens assembly 111 disposed in the accommodating space 12 of the body 11, and the reticle 13 is also disposed in the accommodating space 12 of the body 11. The body 11 can be a tube in which a first lens 113 and a second lens 115 are disposed respectively at two ends of the body 11, thereby forming an optical beam path between the first lens 113 and the second lens 115. The reticle 13 is positioned on the optical beam path between the first lens 113 and the second lens 115, for example, the first lens 113 can be ocular lens and the second lens 115 can be objective lens.

Figure 3:
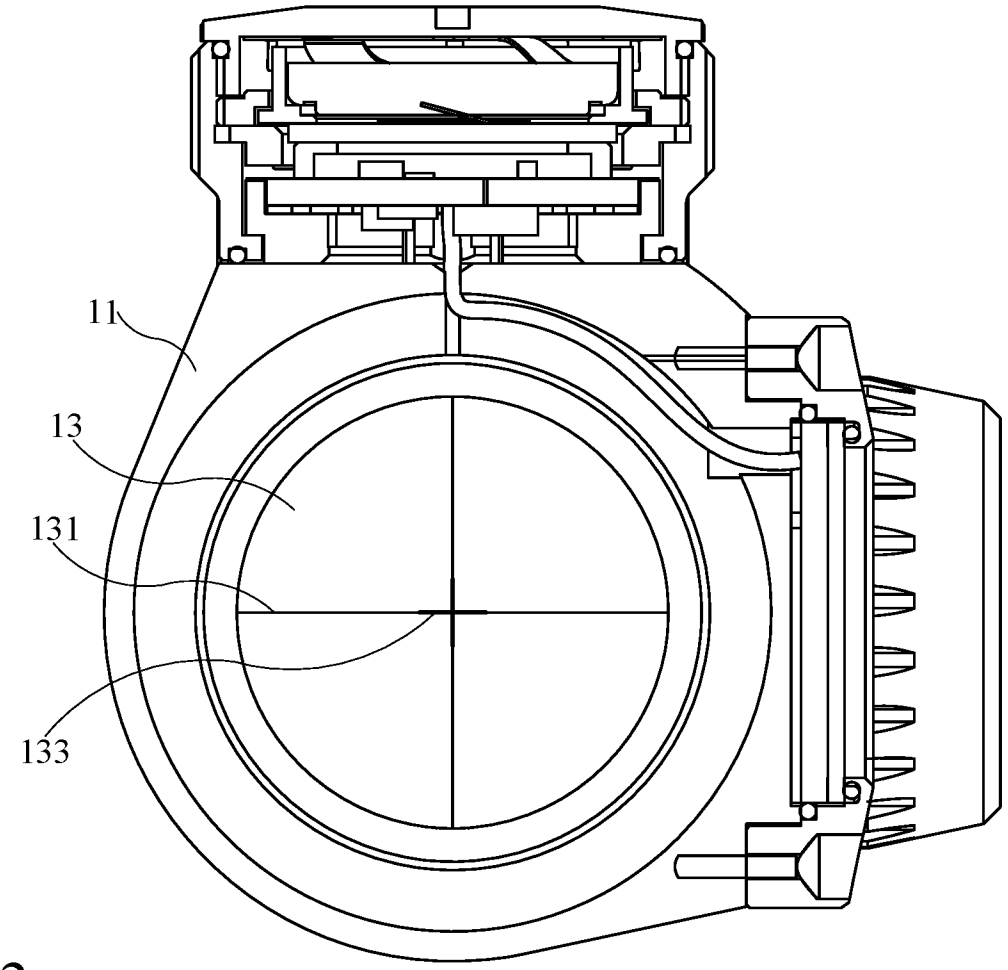
FIG. 3 is a side view of a sighting device according to an embodiment of the invention.

Referring to FIG. 3, the reticle 13 is made of a light transmitting material, like glass or acrylic, wherein a marking 131 is placed on the reticle 13 for providing a precise aiming reference to users. The marking 131 placed on the light transmitting glass or acrylic can be a hairline, a crosshair, a dot, or a post.

The lighting unit 15 is disposed on the body 11 for generating a light, wherein the light generated by the lighting unit 15 is projected onto the reticle 13 to form a reticle pattern 133 on the reticle 13. When the marking 131, for example, is a crosshair, and the reticle pattern 133 is a crosshair, the crossing point of the crosshair of the reticle pattern 133 overlaps the crossing point of the crosshair of the marking 131.

In one embodiment, the lighting unit 15 is located on a side of the reticle 13, as shown in FIG. 2, wherein the light generated by the lighting unit 15 enters the reticle 13 from the side and generates a reticle pattern 133 on the marking 131. In a different embodiment, the lighting unit 15 is disposed between the reticle 13 and the first lens 113, or between the reticle 13 and the second lens 115, wherein the light generated by the lighting unit 15 is directly projected on the surface of the reticle 13, thereby also forming the reticle pattern 133 on the marking 131 of the reticle 13.

In the embodiment of FIG. 2, there is just one lighting unit 15. However, in other embodiments, there can be at least one or a plurality of lighting units 15, wherein the plurality of lighting unit 15 can, for example, project the light generated thereby onto the reticle 13 at the same time to form the reticle pattern 133. In other embodiments, each of the lighting units 15 can generate a different color of light, through which the controller 19 can change the color projected onto the reticle 13 and the reticle pattern 133 by controlling different lighting unit 15 to generate light.

The touch unit 17 is disposed on the body 11 for sensing an external touch and generating a touch signal corresponding to the external touch. The touch unit can be disposed on a side of the body 11 so the users can touch the touch unit 17 with fingers conveniently. The touch unit 17 shown in the figure is circular, but in practice the touch unit 17 can have a shape of a triangle, a square, a rectangular, or a polygon.

The controller 19 is disposed on the body 11 and electrically connected to the touch unit 17 and the lighting unit 15. The controller 19 receives the touch signal transmitted by the touch unit 17 and adjusts a brightness level and/or color of the light generated by the lighting unit 15 according to the touch signal.

In one embodiment, the touch unit 17 can be set to generate different touch signals base on the number of times the touch unit 17 is touched by the user, and the controller adjusts the brightness level and/or color of the lighting unit 15 according to the number of times the user touched the touch unit 17 and/or the touch signal. For example, when the touch unit 17 is touched just once, the lighting unit 15 is set to be the lowest brightness level, and when the touch unit 17 is touched again, the brightness level of the lighting unit 15 increases. Moreover, touching the touch unit 17 one more time would increase the brightness level of the lighting unit 15 more. Through this mode the brightness of light projected by the lighting unit 15 onto the reticle 13 can be adjusted.

In a different embodiment, the touch unit 17 can also generate different touch signals according to a touch position, and the controller 19 adjusts the brightness level and/or color of the lighting unit 15 according to the position on the touch unit 17 where the users touched and/or the touch signal. In one example, when the front end of the touch unit 17 or a position on the touch unit 17 that is closer to the second lens 115 is touched, the lighting unit 15 increases its brightness, and when the back end of the touch unit 17 or a position on the touch unit 17 that is closer to the first lens 113 is touched, the brightness level of the lighting unit 15 decreases. In practice, the touch unit 17 may be set to be touched by other different ways to adjust, through controlling the controller 19, the brightness level and/or color of the lighting unit 15. Therefore, the touch methods described in the above embodiments are merely examples of the invention and do not limit the scope of the invention. In one other embodiment of the invention, there are more than one touch unit 17, for example, two touch units 17, wherein when one touch unit 17 is touched, the brightness level of the lighting unit 15 increases, and when the other touch unit 17 is touched, the brightness level of the lighting unit 15 decreases.

As described, the invention discloses a sighting device 10 equipped with a touch unit 17, a controller 19, and a lighting unit 15 thereon, wherein the user can touch the touch unit 17 directly with fingers and change the brightness level and/or color of light generated by the lighting unit 15, thereby enhancing the convenience of the sighting device 10 during usage. Moreover, in comparison to controlling the light brightness level of the lighting unit 15 with physical buttons, using the touch unit 17 not only can reduce the size of the sighting device 10, but also can prevent water vapor from entering the sighting device 10, which in turn extends the usage life of the sighting device 10 and expands usage environments.

Figure 4:
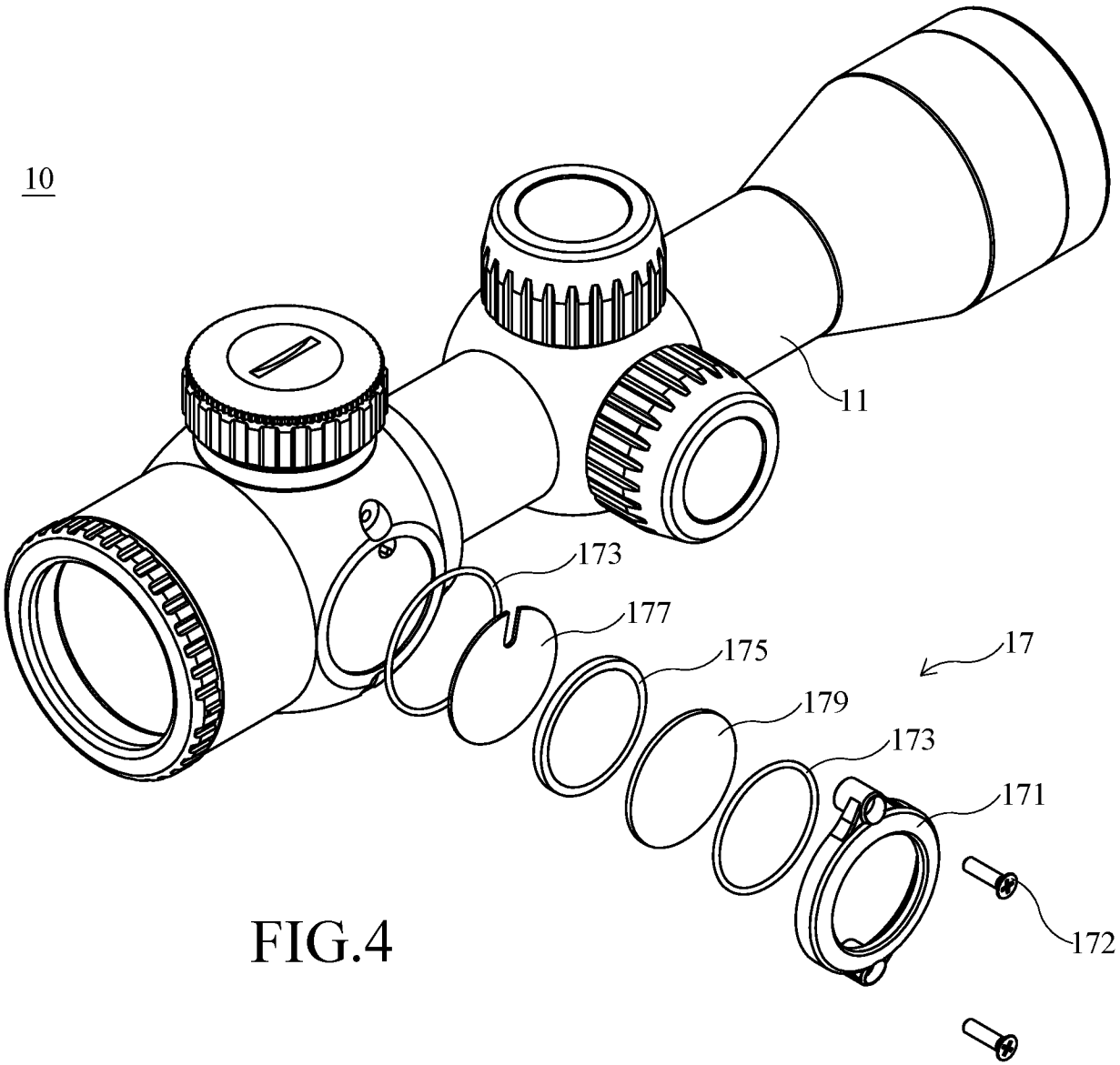
FIG. 4 is an exploded schematic diagram illustrating another portion of a sighting device according to an embodiment of the invention.

FIG. 4 is an exploded schematic diagram of a sighting device according to the invention. Referring to FIGS. 2 and 4, the touch unit 17 of the sighting device 10 is disposed on a side of the body 11 and includes a mount 171 and a touchpad 175, wherein the mount 171 mounts the touchpad 175 on the body 11.

The touchpad 175 is electrically connected to the controller 19 and the mount 171 has an annular structure. The mount 171 mounts the touchpad 175 on the body 11, and because the surface area of the hollow portion of the mount 171 is smaller than the surface area of the touchpad 175, a part of the touchpad 175 placed in the hollow portion of the mount 171 is exposed externally to the outside environment, so that the user can touch the touchpad 175. In particular, when the touchpad 175 is coupled to the controller 19 and placed at a predetermined position on the body 11, the mount 171 is further placed over the touchpad 175, and mounted on the body 11 with securing elements 172, thereby completing the assembly of the touch unit 17.

In one of the embodiments, waterproof seals 173 are used to enhance the durability and waterproof of the touch unit 17, wherein one water proof seal 173 is disposed between the touchpad 175 and the mount 171 and another waterproof seal 173 is disposed between the touchpad 175 and the body 11. The waterproof seal 173 can be, for example, a rubber ring or an O-ring. In a different embodiment, a cushion 177 is disposed between the touchpad 173 and the body 11 and a protective cover 179 is disposed between the touchpad 175 and the mount 171 to provide more protection to the touchpad 175. The protection cover 179 can be made of glass or acrylic.

It is to be noted that the described embodiments are merely illustrations of ways to implement the touch unit 17, not to be construed as limitations to the structure of the touch unit 17. Different implementations of the touch unit 17 can also be used during practical application.

Figure 5:
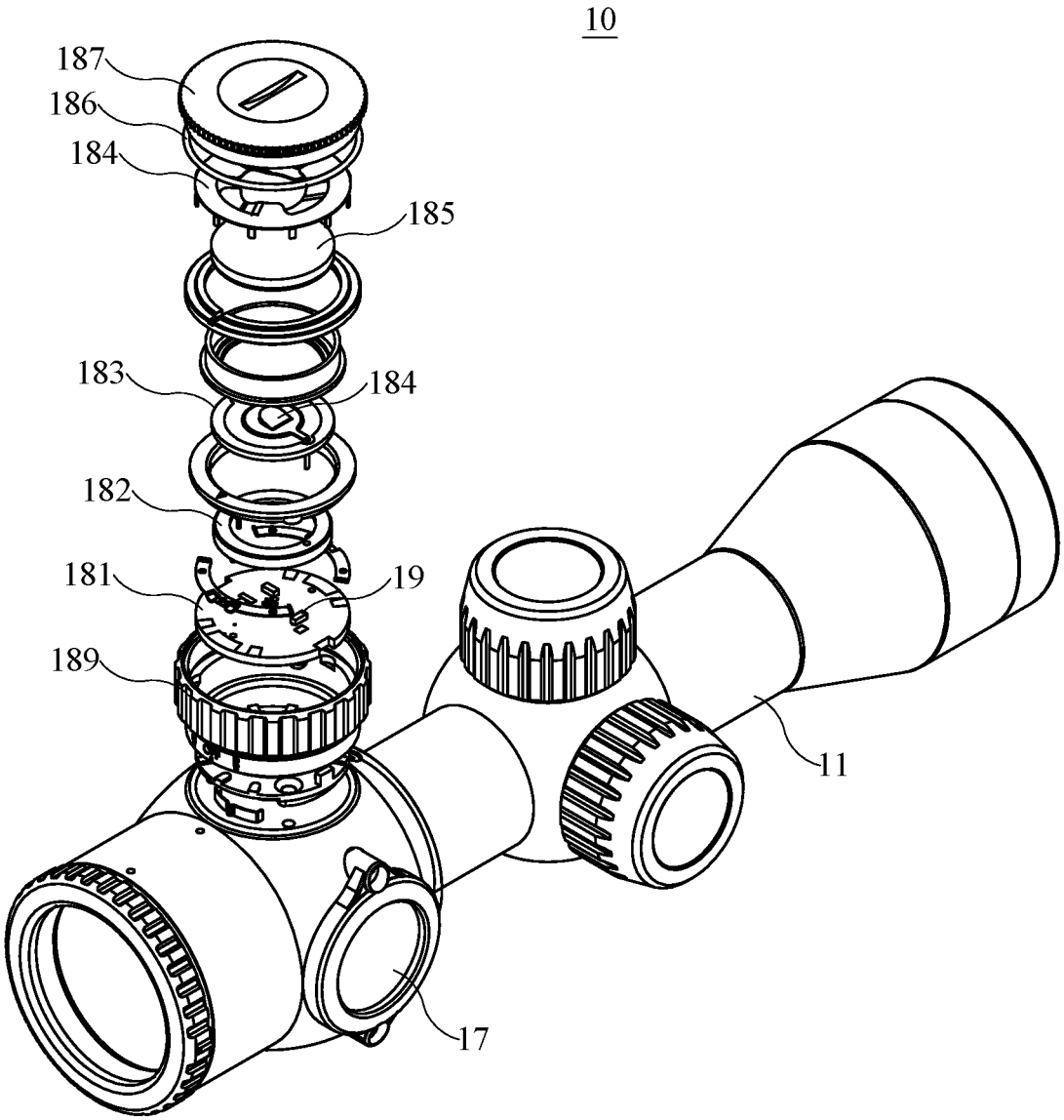
FIG. 5 is an exploded schematic diagram illustrating yet another portion of a sighting device according to an embodiment of the invention.

FIG. 5 is an exploded schematic diagram of a sighting device according to one embodiment of the invention. In reference to FIG. 2 and FIG. 5, the sighting device 10 includes a first circuit board 181 and a second circuit board 183, wherein the first circuit board 181 is electrically connected to the second circuit board 183. In practice, the first circuit board 181 and the second circuit board 183 can be integrated into a single circuit board. Thus, the scope of the invention is not limited by the quantity of circuit boards.

In one embodiment, the first circuit board 181 and the second circuit board 183 are configured in an overlapping manner, wherein the first circuit board 181 is closer to the body 11. The controller 19 is disposed on the first circuit board 181, for example, on the upper surface of the first circuit board 181, and the lighting unit 15 is disposed on the lower surface of the first circuit board 181, wherein the controller 19 is electrically connected to the lighting unit 15 via the traces on the first circuit board 181 and thereby controlling the brightness level and/or color of the lighting unit 15.

The second circuit board 183 is electrically connected to a power unit 185, such as batteries, and the power unit 185 provides power to the controller 19, the lighting unit 15, and the touch unit 17 via the second circuit board 183 and the first circuit board 181. In one embodiment of the invention, a spacer 182 is disposed between the first circuit board 181 and the second circuit board 183, and metal domes 184 are disposed on the two surfaces of the power unit 182, which also serve to secure the power unit 185. Waterproof seals 186 can also be selectively disposed between each component to prevent water vapor from entering.

Moreover, a frame 189 can be disposed on the body 11, wherein the first circuit board 181, the controller 19, the second circuit board 183, and the power unit 185 are placed in the frame 189, and a cover 187 is secured on the frame 189 to mount the power unit 185 inside the cover 187 and the frame 189.

The implementation of the controller 19 and the power unit 185 disposed on the sighting unit 10 as described above is merely an illustration of embodiment, and therefore it does not limit the scope of the invention. The controller 19 and the power unit 185 can also be disposed on the body 11 through other arrangements.

More specifically, the sighting device 10 shown in FIGS. 1-5 is generally referred as a telescopic sight, and the main objective of the invention is to dispose the lighting unit 15, the touch unit 17 and the controller 19 on the telescopic sight. According to the surrounding environment, the user may control the brightness level and/or color of the light generated by the lighting unit 15 through touching the touch unit 17 to enhance the convenience of using the sighting device 10.

Figure 6:
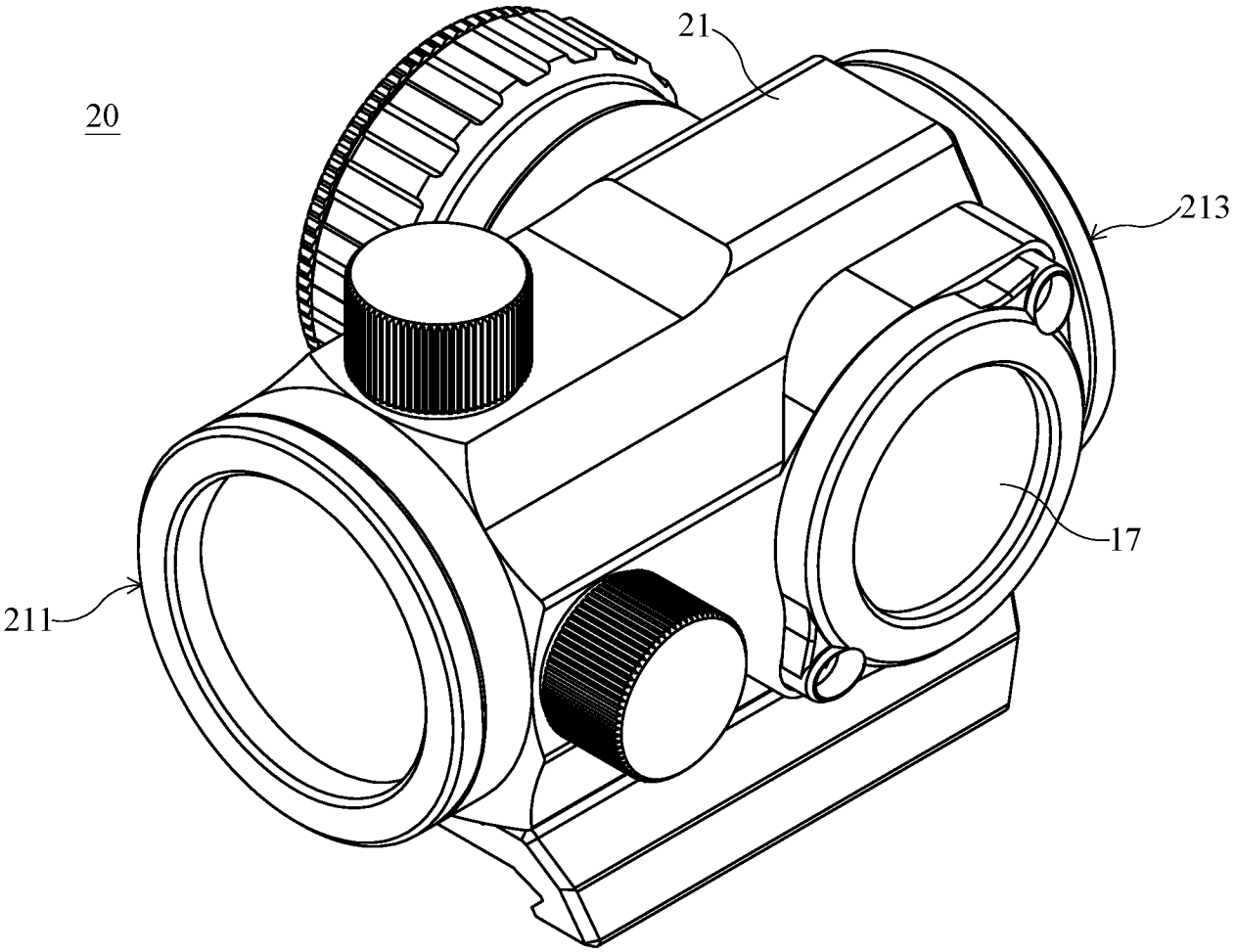
FIG. 6 is a schematic diagram of a sighting device according to another embodiment of the invention.
Figure 7:
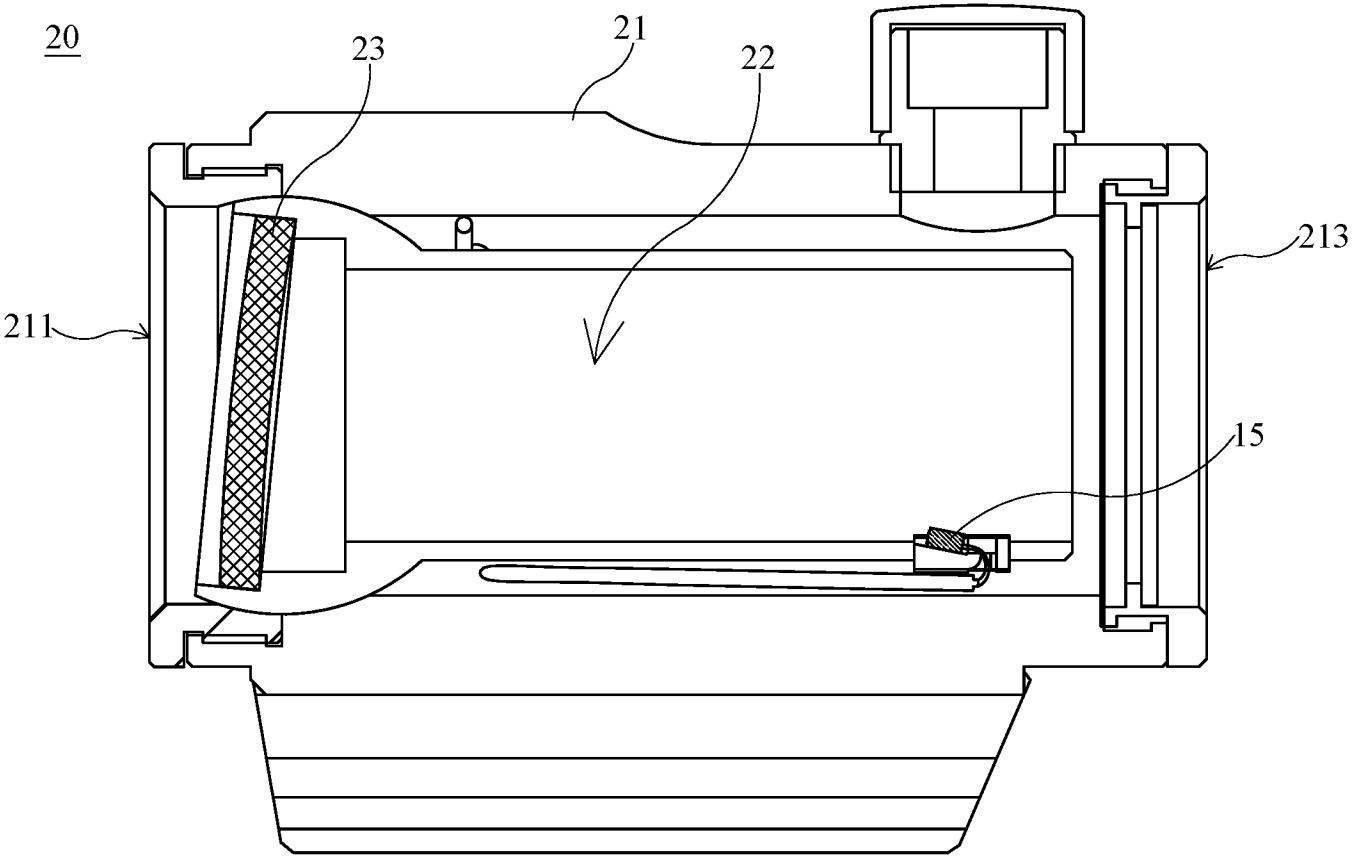
FIG. 7 is a cross-sectional schematic diagram illustrating a portion of a sighting device according to another embodiment of the invention.

FIGS. 6 and 7 are, respectively, a schematic diagram and a cross-sectional schematic diagram illustrating a portion of a sighting device according to another embodiment of the invention. As shown in the figures, a sighting device 20 of the invention includes a body 21, an optical beam splitter 23, a lighting unit 15, a touch unit 17, and a controller 19, wherein the body 21 is a hollow tube with an accommodating space 22 and the lighting unit 15 is used to generate and project light.

The optical beam splitter 23 is disposed in the accommodating space 22 of the body 21, and a first lens 211 and a second lens 213 are respectively disposed at two ends of the body 21. The second lens 213 is, for example, an eye viewing side, and an optical beam path is formed between the first lens 211 and the second lens 213, wherein the optical beam splitter 23 is disposed on the optical beam path between the first lens 211 and the second lens 213.

Referring to FIG. 7, the optical beam splitter 23 is made of light transmitting material and one or more layers of coating are plated on the surface of the optical beam splitter 23. The lighting unit 15 is disposed on the body 21 and projects the generated light onto the optical beam splitter 23. Looking from the outer side of the second lens 213 into the direction of the first lens 211, the light spot projected on the optical beam splitter 23 is presented at the center of the aiming window and can be used for aiming purpose.

In particular, the optical beam splitter 23 is a translucent lens with curvature, including a recess side, wherein the recess side of the optical beam splitter 23 faces the first lens 213 and has one or more layers of coating plated thereon. When the lighting unit 15 generates and projects light onto the recess side of the optical beam splitter 213, the light is reflected by the coating on the recess side, and the user can see a red dot formed on the first lens 213 by the lighting unit 15.

In the embodiment shown in FIG. 7, the quantity of lighting unit 15 is one. In a different embodiment, the quantity of lighting unit 15 is plural, wherein each lighting unit 15 generates a different light color. When the controller 19 controls the different lighting units 15 to generate light, the light color being projected onto the optical beam splitter 23 can be changed.

The touch unit 17 is disposed on the body 21 for sensing an external touch, and, in correspondence thereto, generating a touch signal. The touch unit 17 is disposed, for example, at a side of the body 21, which is convenient for the user to touch the touch unit 17 with fingers. Disposing the touch unit 17 at the side of the body 21 is merely an embodiment of the invention and does not limit the scope thereof. Under different conditions, the touch unit 17 can be disposed at other places.

The controller 19 is disposed on the body 21 and electrically connected to the touch unit 17 and the lighting unit 15. The controller 19 receives the touch signal transmitted by the touch unit 17 and adjusts the brightness level and/or color of the light generated by the lighting unit 15 according to the touch signal. The details of adjusting the lighting unit 15 through the touch unit 17 have been described in the previous embodiment, and thus will not be repeated herein.

Figure 8:
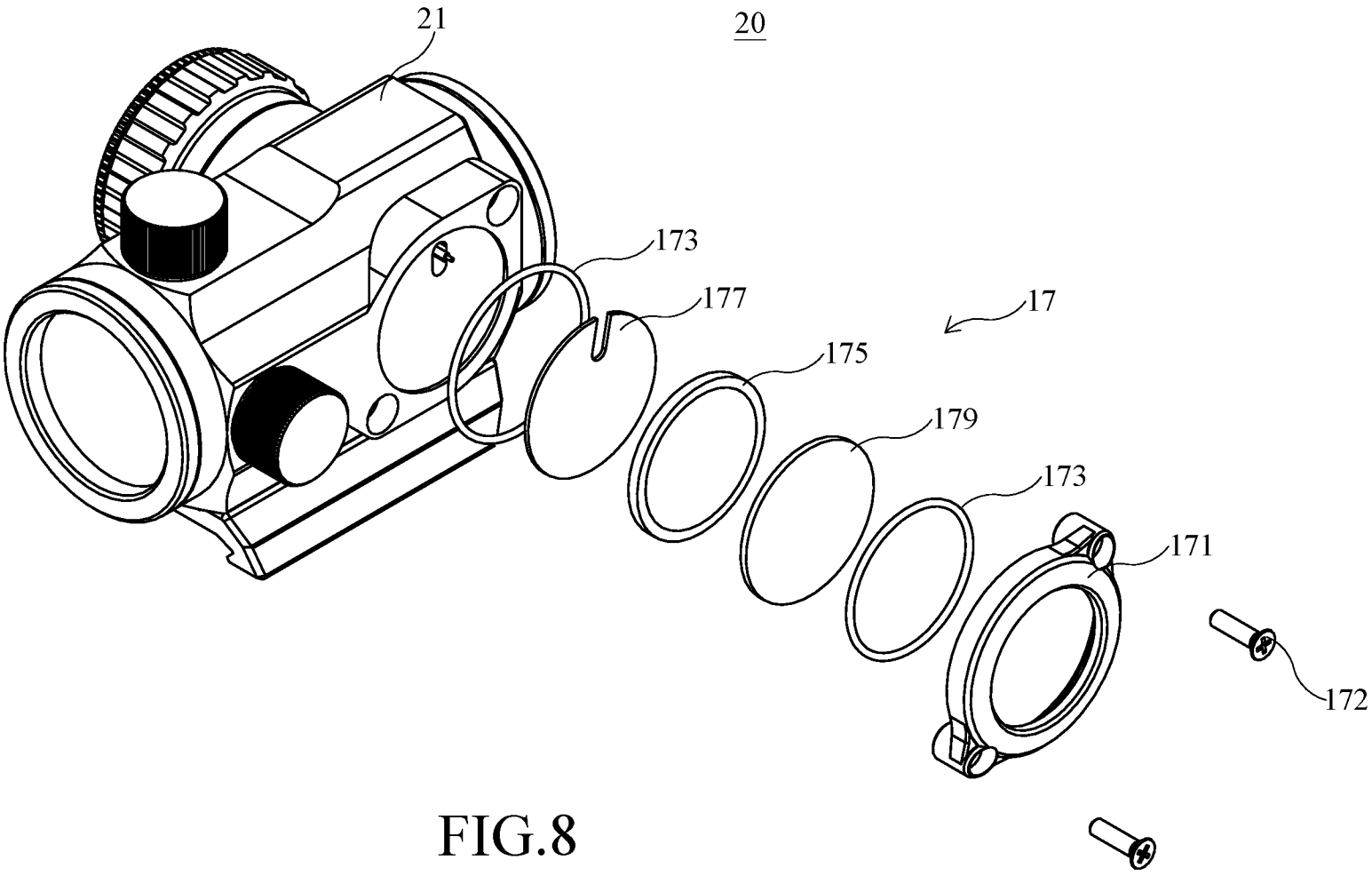
FIG. 8 is an exploded schematic diagram illustrating another portion of a sighting device according to another embodiment of the invention.

Referring to FIG. 8, which is an exploded schematic diagram of the sighting device according to one embodiment of the invention, the touch unit 17 of the sighting device 20 is disposed at the side of the body 21 and includes a mount 171 and a touchpad 175. More specifically, the touch unit 17 of this embodiment has a similar structure as that shown in FIG. 4, which includes a mount 171, securing elements 172, waterproof seals 173, a touchpad 175, a cushion 177 and/or a protective cover 179, and thus will not be repeated herein. It is to be noted that the detailed structure of the touch unit 17 described in the above embodiments does not limit the scope of invention.

Figure 9:
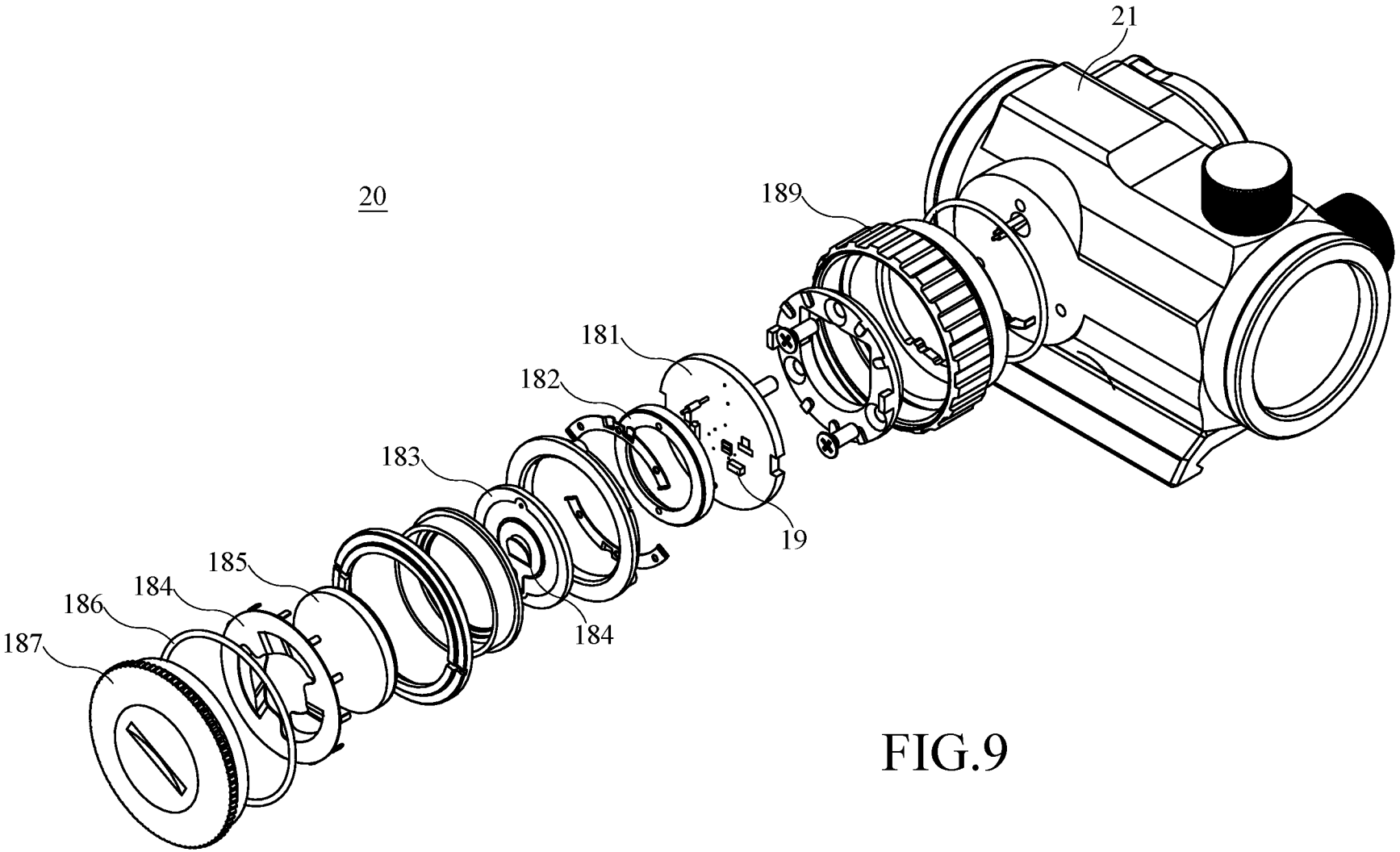
FIG. 9 is an exploded schematic diagram illustrating yet another portion of a sighting device according to another embodiment of the invention.

FIG. 9 is an exploded schematic diagram illustrating a portion of the sighting device according to one embodiment of the invention. The sighting device 20 includes a first circuit board 181 and a second circuit board 183 electrically connected to the first circuit board 181. The controller 19 is disposed on the first circuit board 181 and the power unit 185 is electrically connected to the second circuit board 183. The power unit 185 is, for example, a battery and provides power to the controller 19, the lighting unit 15, and the touch unit 17 through the second circuit board 183 and the first circuit board 181.

In one embodiment of the invention, the first circuit board 181 and the second circuit board 183 are arranged in an overlapping manner, and a spacer 182 is disposed between the first circuit board 181 and the second circuit board 183. As well, the first circuit board 181 and the second circuit board 183 can be integrated into on single circuit board. Moreover, metal domes 184 can be respectively disposed on two surfaces of the power unit 185 and secure the power unit 185 in place.

Furthermore, a frame 189 can be disposed on the body 21, wherein the first circuit board 181, the controller 19, the second circuit board 183, and the power unit 185 are placed in the frame 189, and a cover 187 can be fixed on the frame 189 by securing elements, such that the power unit 185 is mounted inside the cover 187 and the frame 189.

The embodiment merely described a way to dispose the controller 19 and the power unit 185 on the sighting device 20 but does not limit the specific structure to the scope thereof. Different ways of disposing the controller 19 and the power unit 185 on the body 21 can also be used.

In general, the sighting device 20 shown in FIGS. 6-9 is referred as a red dot sight, and the main objective of the invention is to dispose a touch unit 17 and a controller 19 on the red dot sight, so the user can touch the touch unit 17 to control the brightness and/or color of the light generated by the lighting unit 15 base on the environment the user is in to enhance the usability and convenience of the sighting device 20.

The above disclosure is only the preferred embodiment of the present invention, and not used for limiting the scope of the present invention. All equivalent variations and modifications on the basis of shapes, structures, features and spirits described in claims of the present invention should be included in the claims of the present invention.

The invention claimed is:

1. A sighting device comprising:

a body, the body having an accommodating space and comprising a lens or at least one lens assembly disposed in the accommodating space;

a reticle, disposed in the accommodating space of the body;

at least one lighting unit disposed on the body for generating a light and projecting the light onto the reticle to form a reticle pattern on the reticle;

at least one touch unit disposed on the body for sensing an external touch and generating a touch signal in correspondence to the external touch; and a controller disposed on the body and electrically connected to the touch unit and the lighting unit, wherein the controller adjusts a brightness level or a color generated by the light according to the touch signal transmitted by the touch unit, wherein the touch unit comprises a touchpad and a mount, the mount has an annular structure and mounts the touchpad on the body to expose a part of the touchpad.

2. The sighting device of claim 1, further comprising a power unit for providing power to the controller, the lighting unit and the touch unit.

3. The sighting device of claim 1, wherein the touch unit is circular, triangular, square, rectangular, or polygonal.

4. A sighting device comprising:

a body having an accommodating space;

an optical beam splitter disposed in the accommodating space of the body;

at least one lighting unit for generating a light and projecting the light onto the optical beam splitter;

at least one touch unit disposed on the body for sensing an external touch and generating a touch signal in correspondence to the external touch; and a controller disposed on the body and electrically connected to the touch unit and the lighting unit, wherein the controller adjusts a brightness level or a color generated by the lighting unit according to the touch signal transmitted by the touch unit.

5. The sighting device of claim 4, further comprising a power unit for providing power to the controller, the lighting unit, and the touch unit.

6. The sighting device of claim 4, wherein the touch unit comprises a touchpad and a mount, the mount has an annular structure and mounts the touchpad on the body to expose a part of the touchpad.

7. The sighting device of claim 4, wherein the touch unit is circular, triangular, square, rectangular, or polygonal.

* * * * *